US011919120B2

(12) United States Patent
Lischka et al.

(10) Patent No.: US 11,919,120 B2
(45) **Date of Patent: *Mar. 5, 2024**

(54) POLISHING SYSTEM WITH CONTACTLESS PLATEN EDGE CONTROL

(71) Applicant: Applied Materials, Inc., Santa Clara, CA (US)

(72) Inventors: David J. Lischka, Austin, TX (US); Jay Gurusamy, Santa Clara, CA (US); Danielle Loi, San Jose, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 190 days.

This patent is subject to a terminal disclaimer.

(21) Appl. No.: 17/185,873

(22) Filed: Feb. 25, 2021

(65) Prior Publication Data

US 2022/0266413 A1 Aug. 25, 2022

(51) Int. Cl.
*B24B 37/20* (2012.01)
*B24B 37/005* (2012.01)

(52) U.S. Cl.
CPC ..... *B24B 37/005* (2013.01); *B24B 37/20* (2013.01)

(58) Field of Classification Search
CPC ..... B24B 37/005; B24B 37/20; B24B 37/26; B24B 37/34; B24B 7/228; B24B 41/061; B24B 49/16
USPC ..... 451/5, 41, 54, 285, 287, 288, 290
See application file for complete search history.

(56) References Cited

U.S. PATENT DOCUMENTS 5,899,801 A * 5/1999 Tolles ..... B24B 37/345 438/692
5,980,368 A 11/1999 Chang et al.
6,435,949 B1 8/2002 Katsuoka et al.
6,913,518 B2 7/2005 Chen et al.
(Continued)

FOREIGN PATENT DOCUMENTS

EP 0747167 12/1996
TW 201733740 10/2017
(Continued)

OTHER PUBLICATIONS

Office Action in Taiwanese Appln. No. 111107044, dated Dec. 26, 2022, 20 pages (with English summary and search report).
(Continued)

*Primary Examiner* — Laura C Guidotti
*Assistant Examiner* — Caleb Andrew Holizna
(74) *Attorney, Agent, or Firm* — Fish & Richardson P.C.

(57) ABSTRACT

A polishing system includes a platen having a top surface to support a main polishing pad. The platen is rotatable about an axis of rotation that passes through approximately the center of the platen. An annular flange projects radially outward from the platen to support an outer polishing pad. The annular flange has an inner edge secured to and rotatable with the platen and vertically fixed relative to the top surface of the platen. The annular flange is vertically deflectable such that an outer edge of the annular flange is vertically moveable relative to the inner edge. An actuator applies pressure to an underside of the annular flange in an angularly limited region, and a carrier head holds a substrate in contact with the polishing pad and is movable to selectively position a portion of the substrate over the outer polishing pad.

20 Claims, 6 Drawing Sheets

(56) References Cited

U.S. PATENT DOCUMENTS

| | | | | |
|---|---|---|---|---|
| 6,939,212 | B1 | 9/2005 | Pham | |
| 7,422,516 | B2 | 9/2008 | Butterfield et al. | |
| 9,662,762 | B2 | 5/2017 | Gurusamy et al. | |
| 10,058,974 | B1 | 8/2018 | Chen et al. | |
| 2002/0033230 | A1 | 3/2002 | Hayashi et al. | |
| 2002/0127953 | A1 | 9/2002 | Doan et al. | |
| 2003/0003850 | A1 | 1/2003 | Eaton | |
| 2003/0060134 | A1* | 3/2003 | Gurusamy | B24B 37/12 451/40 |
| 2009/0117835 | A1 | 5/2009 | Shih | |
| 2010/0120334 | A1 | 5/2010 | Crocco et al. | |
| 2011/0021115 | A1 | 1/2011 | Oh et al. | |
| 2011/0239876 | A1 | 10/2011 | Brown | |
| 2012/0171933 | A1 | 7/2012 | Chen | |
| 2014/0273765 | A1 | 9/2014 | Chang et al. | |
| 2014/0273766 | A1* | 9/2014 | Chang | B24B 37/005 451/259 |
| 2015/0065020 | A1 | 3/2015 | Roy et al. | |
| 2018/0056477 | A1 | 3/2018 | Butterfield et al. | |
| 2020/0206866 | A1 | 7/2020 | Gurusamy et al. | |

FOREIGN PATENT DOCUMENTS

| | | |
|---|---|---|
| TW | 201835998 | 10/2018 |
| WO | WO 2002/078901 | 10/2002 |
| WO | WO 2018/198997 | 11/2018 |

OTHER PUBLICATIONS

International Search Report and Written Opinion in International Appln. No. PCT/US2022/015658, dated May 13, 2022, 11 pages.

* cited by examiner

POLISHING SYSTEM WITH CONTACTLESS PLATEN EDGE CONTROL

TECHNICAL FIELD

The present disclosure relates to chemical mechanical polishing substrate with control of the pressure applied by a platen.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

SUMMARY

In one aspect, a polishing system includes a platen having a top surface to support a main polishing pad. The platen is rotatable about an axis of rotation that passes through approximately the center of the platen. An annular flange projects radially outward from the platen to support an outer polishing pad. The annular flange has an inner edge secured to and rotatable with the platen and vertically fixed relative to the top surface of the platen. The annular flange is vertically deflectable such that an outer edge of the annular flange is vertically moveable relative to the inner edge. An actuator applies pressure to an underside of the annular flange in an angularly limited region, and a carrier head holds a substrate in contact with the polishing pad and is movable to selectively position a portion of the substrate over the outer polishing pad.

Implementations may optionally include, but are not limited to, one or more of the following advantages.

The described techniques allow contactless control, i.e., an actuator can control a vertical position of an annular flange of the platen or control an upward pressure of the annular flange on the polishing pad and substrate without any physical contact between the actuator and the annular flange. As comparing to techniques that require the actuator to contact with the annular flange in order to apply a pressure, fewer particles can be generated, thus reducing the likelihood of defects.

The described techniques can reduce polishing non-uniformity, particularly at the edge of a substrate, as respective pressures can be applied to the edge of the substrate when polishing to increase or reduce the polishing rate at the edge to ensure the substrate to have an evenly polished thickness at the end of a polishing process.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

In some chemical mechanical polishing operations, a portion of a substrate can be under polished or over polished. In particular, the substrate tends to be over-polished or under-polished at or near the substrate edge, e.g., a band located 0 to 10 mm from the substrate edge. One technique to address such polishing non-uniformity is to transfer the substrate to a separate "touch up" tool, e.g., to perform edge-correction. However, the additional tool consumes valuable footprint within the clean room, and can have an adverse effect on throughput.

A proposed solution to this issue is to provide an integrated polishing station in which an actuator contacts an annular flange and deflects the flange upwardly to increase pressure on the substrate edge. However, particles can be produced when the actuator contacts the annular flange, e.g., due to friction between the solid components. The particles can contaminate the substrate, and/or the clean room, leading to defects. However, these problems can be addressed by adopting a contactless actuator to apply pressure onto the annular flange without physical contact between the solid components.

Figure 1:
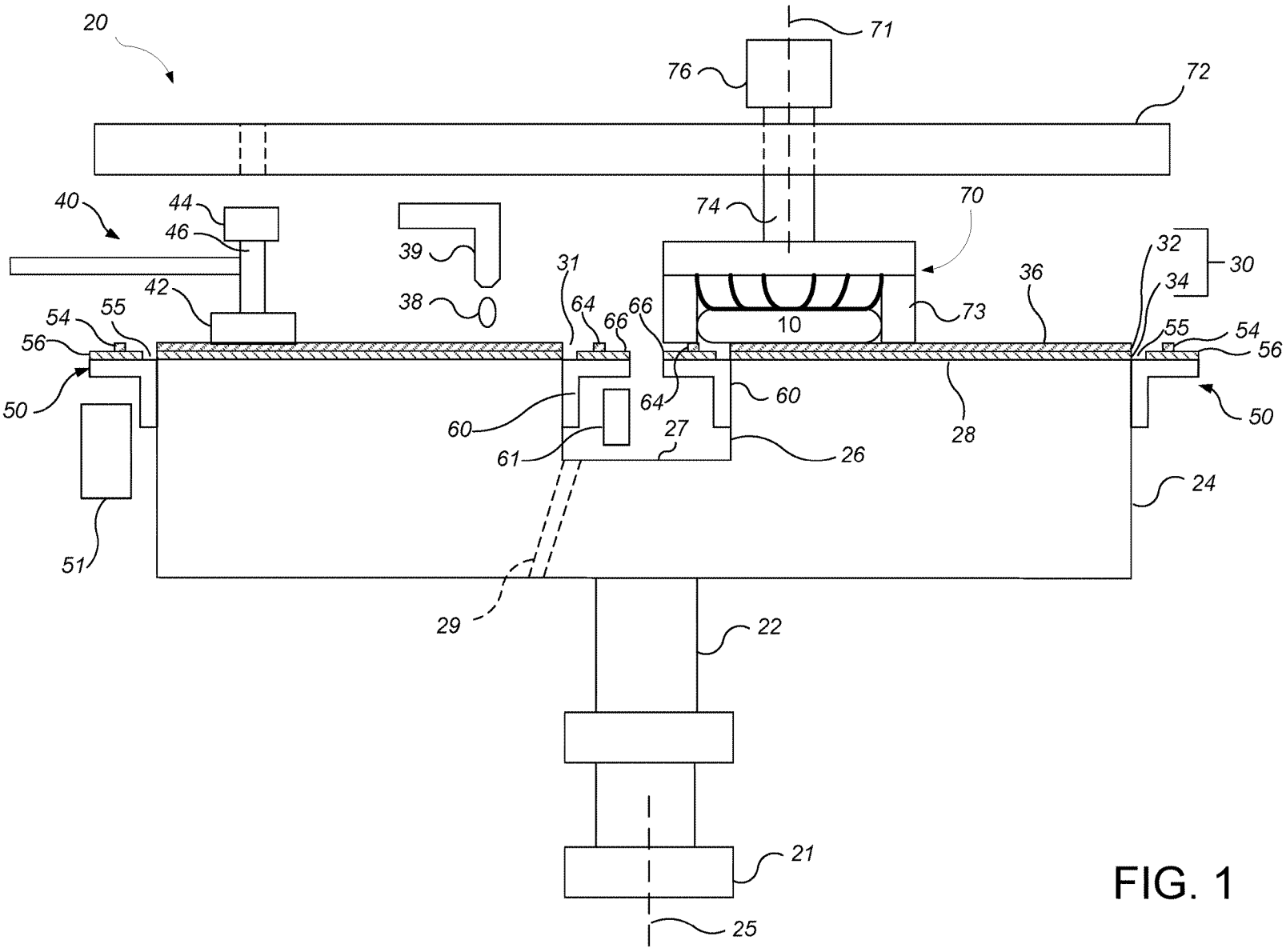
FIG. 1 shows a schematic cross-sectional view of an example chemical mechanical polishing system.
Figure 2:
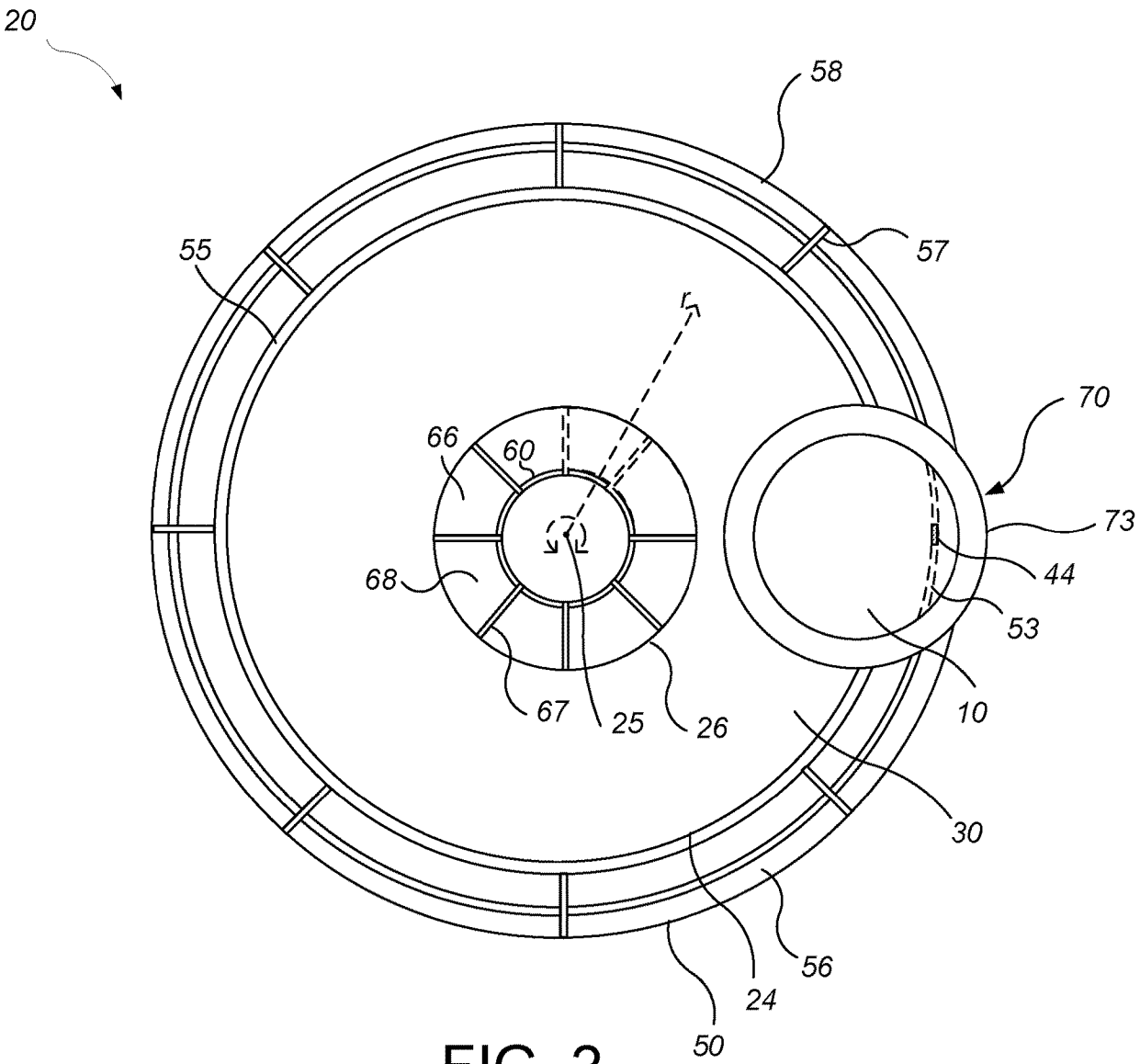
FIG. 2 shows a schematic top view of an example chemical mechanical polishing system of FIG. 1.

FIGS. 1 and 2 show an example polishing system 20 operable to polish a substrate 10. The polishing system 20 includes a rotatable platen 24, on which a main polishing pad 30 is situated.

The platen is operable to rotate about an axis 25. For example, a motor 21 can turn a drive shaft 22 to rotate the platen 24. In some implementations, the platen 24 is configured to provide an annular upper surface 28 to support the main polishing pad 30. In some implementations, an aperture 26 is formed in the upper surface 28 at the center of the platen 24. A center of the aperture 26 can be aligned with the axis of rotation 25. For example, the aperture 26 can be circular and the center of the aperture 26 can be co-axial with the axis of rotation 25. Where the platen 24 has an annular upper surface, a hole 31 can be formed through the main polishing pad 30 to provide the polishing pad with an annular shape.

In some implementations, the aperture 26 is a recess that extends partially but not entirely through the platen 24. In some implementations, the aperture 26 provides entirely through the platen 24, e.g., the aperture 26 provides a passage through the platen 24. As shown in FIG. 1, the aperture 26 can also provide draining for polishing residue (e.g., polishing liquid 38 or debris from the polishing process). A conduit 29 can drain the polishing residue from a recess that does not extend through the platen 24.

The diameter of the aperture 26 (e.g., the portion adjacent the surface 28, either as a recess or as an upper portion of the passage through the platen 24) can be about 5% to 40% of the diameter of the platen 24, e.g., about 5% to 15%, or 20% to 30%. For example, the diameter can be 3 to 12 inches in a 30 to 42 inch diameter platen.

However, the aperture 26 in the platen 24 and hole 31 in the polishing pad 30 are optional; both the polishing pad 30 and platen 24 can be solid circular bodies with solid circular upper surfaces.

The main polishing pad 30 can be secured to the upper surface 28 of the platen 24, for example, by a layer of adhesive. When worn, the main polishing pad 30 can be detached and replaced. The main polishing pad 30 can be a two-layer polishing pad with an outer polishing layer 32 having a polishing surface 36, and a softer backing layer 34. If the main polishing pad 30 is annular, then the main polishing pad 30 has an inside edge which defines the perimeter of the aperture 26 through the pad 30. The inner edge of the pad 30 can be circular.

The polishing system 20 can include a polishing liquid delivery arm 39 and/or a pad cleaning system such as a rinse fluid delivery arm. During polishing, the arm 39 is operable to dispense a polishing liquid 38, e.g., slurry with abrasive particles. In some implementations, the polishing system 20 include a combined slurry/rinse arm. Alternatively, the polishing system can include a port in the platen operable to dispense the polishing liquid onto the main polishing pad 30.

The polishing system 20 includes a carrier head 70 operable to hold the substrate 10 against the main polishing pad 30. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad, e.g., by moving in a radial slot in the carousel as driven by an actuator, by rotation of the carousel as driven by a motor, or movement back and forth along the track as driven by an actuator. In operation, the platen 24 is rotated about its central axis 25, and the carrier head is rotated about its central axis 71 and translated laterally across the top surface of the polishing pad.

The polishing system 20 can also include a conditioner system 40 with a rotatable conditioner head 42, which can include an abrasive lower surface, e.g. on a removable conditioning disk, to condition the polishing surface 36 of the main polishing pad 30. The conditioner system 40 can also include a motor 44 to drive the conditioner head 42, and a drive shaft 46 connecting the motor to the conditioner head 42. The conditioner system 40 can also include an actuator configured to sweep the conditioner head 42 laterally across the main polishing pad 30, the outer polishing pad 56, and an optional inner polishing pad 66.

The polishing system 20 also includes at least one annular flange that is secured to and rotates with the platen. A portion of an inner or outer polishing pad is placed on the flange, and the flange is deformable by an actuator such that an angularly limited section of the inner or outer polishing pad is biased against the bottom surface of the substrate. The annular flange can project outwardly from an outer edge of the platen, project inwardly from an inner edge of an annular platen, or there can be two flanges, one for each position.

As shown in the example of FIGS. 1 and 2, the polishing system 20 includes an annular flange 50 that projects radially outward from the platen 24. If not deflected or deformed, a top surface of the annular flange 50 is substantially coplanar with the upper surface 38 of the platen 24. An inner edge of the annular flange 50 is secured to and rotatable with the platen 24. Therefore the annular flange 50 can rotate with the platen 24 when the drive shaft 22 rotates the platen 24 (so the annular flange 50 does not require a separate motor for rotation). The annular flange 50 can an elastic material that is able to deflect. For example, the annular flange can be made of PTFE.

The inner edge of the annular flange 50 is vertically fixed relative to the top surface of the platen 24. However, the annular flange 50 is vertically deflectable such that an outer edge of the annular flange 50 is vertically movable relative to the inner edge of the annular flange 50. In particular, the polishing system 20 includes a contactless actuator 51 to apply pressure to an underside of the annular flange 50 in an angularly limited region 44, thus deforming a segment of the outer polishing pad 56, i.e., the actuator 51 can apply pressure to the annular flange 50 without physically contact with the annular flange 50.

The polishing system 20 can include an outer polishing pad 56 that is supported by and secured to the annular flange 50. The outer polishing pad 56 can be used to perform corrective polishing on the substrate, e.g., on a portion of the substrate 10 at or near the edge of a substrate 10. The outer polishing pad 56 can having a similar layer structure as the main polishing pad 30, e.g., a polishing layer supported on a backing layer.

The outer polishing pad 56 can be angularly segmented. Referring to FIG. 2, the otherwise annular outer polishing pad 56 can be broken into angular pad segments 58 by channels 57. The channels 57 can be spaced at equal angular intervals around the axis of rotation of the platen, and the segments 58 can have equal arc lengths. Although FIG. 2 illustrates eight channels 57 that divide the outer polishing pad into eight segments 58, there could be a larger or small number of channels 57 and segments 58. The channels 57 can also be used to drain the polishing by-product, e.g., slurry 38 or debris from the polishing process. The pad segments 58 that are not below the substrate 10 can be conditioned by the conditioning system 40 as they spin about the axis of rotation 25 of the platen 24.

The polishing surface of the outer polishing pad 56 can be separated from the main polishing pad 30 by a gap 55. The channels 57 can extend to the gap 55 so that polishing residue (e.g., polishing slurry 38 or debris from the polishing process) can drain from the channels 57 into the gap 55. One or more conduits 59 with openings within the gap 55 can enable the polishing residue to drain from the gap 55 (see FIGS. 4-6).

The outer polishing surface 54 of the outer polishing pad 56 can be annular, and can be concentric with the axis of rotation of the platen. In some implementations, the outer polishing pad 56 includes an annular projection that extends upwardly from a lower layer 25 (see FIG. 5). The channels 57 can divide the annular projection into a plurality of arcs 53. A top surface of the annular projection provides the outer polishing surface 54. Each arc 53 can have a width w (measured along a radius of the platen). The width w can be uniform angularly along the arc 53. Each arc can have the same dimension, or the widths w can vary from one arc 53 to another. The width w is sufficiently small to permit the outer polishing pad 56 to perform corrective polishing on a narrow portion of the substrate 10, e.g., a region 1 to 30 mm wide, e.g., 1 to 10 mm wide, e.g., 5 to 30 mm wide (e.g., on a 300 mm diameter circular substrate).

The annular projection can have a rectangular cross section (perpendicular to the top surface of the flange or to the polishing surface 36). The side walls the annular projection can be vertical, so that as the annular projection wears down, the area affected on the substrate 10 by the annular projection remains the same. The radial position of the projection and width of the projection can selected based on empirically measured non-uniformity measurements for a particular polishing process.

However, many other configurations are possible for the outer polishing surface 54. For example, the outer polishing surface 54 could be provided by cylindrical projections spaced angularly, e.g., evenly spaced, around the axis of rotation.

Figure 3:
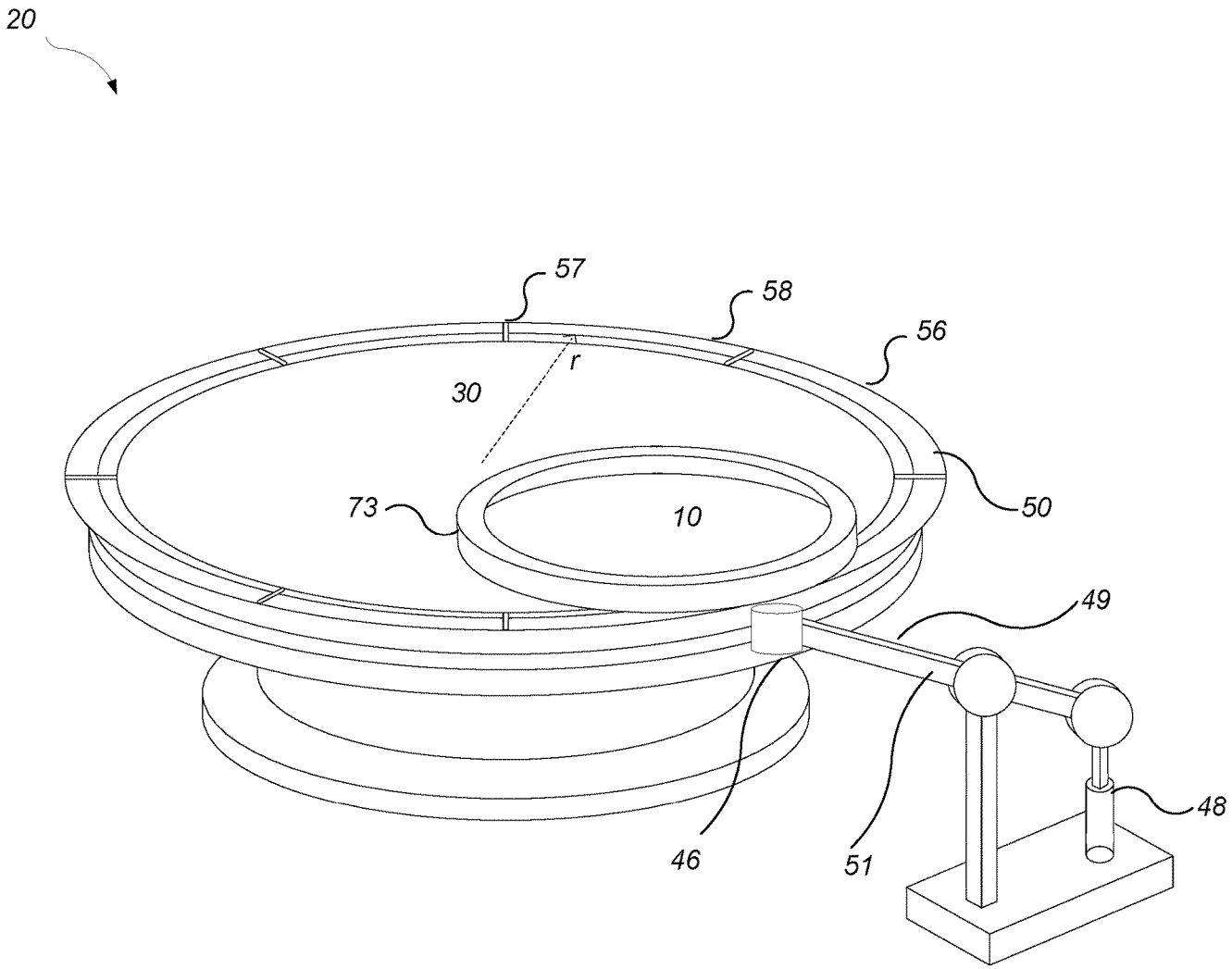
FIG. 3 shows a perspective view of an example chemical mechanical polishing system.

The contactless actuator 51 can be a mechanical and/or electrical apparatus. The contactless actuator 51 can have, for example as shown in FIG. 3, an air cylinder 48 mounted to a pivoting arm 49 that can swing upwardly and downwardly to adjust the distance between the annular flange 50 and an actuator head 46. Alternatively, the contactless actuator 51 can be static and fixed near the polishing station 20 with an actuator head 46 having preset distance between the annular flange 50 and the actuator head 46.

The contactless actuator 51 can apply an upward force to an annularly limited region 44 of the annular flange 50 without physical contact between solid components. The annularly limited region 44 is less than all of the radial arc 53 of the projection spanned by the substrate 10. In particular, the annually limited region 44 is about 0.5-4 mm wide and 20-50 mm long. The upward pressure applied by the contactless actuator 51 can locally deflect the annular flange 50, such that a portion of the projection of the annular flange 50 corresponding to the annularly limited region 44 moves to contact with the substrate 10. The amplitude of the upward pressure by the contactless actuator 51 can depend on the distance between the annular flange 50 and the actuator head 46. Alternatively, if the distance between the annular flange 50 and the actuator head 46 is fixed, the amplitude of the upward pressure depends on the force generated by the actuator head 46 controlled by a controller.

The upward pressure from the contactless actuator 51 on the flange 50 can be generated by magnetic force, or by pneumatic or hydraulic pressure, e.g., by the actuator head jetting fluid or air against the underside of the flange 50. The magnetic force can be generated between two permanent magnets, or between one permanent magnet and one electromagnet. The magnetic force is repulsive such that it can provide an upward pressure on the annular flange 50. The detail descriptions of the contactless actuator 51 will be discussed later.

The carrier head 70 is movable to selectively position a portion of the substrate 10 over the outer polishing pad 56. In particular, the carrier head 70 can position a first portion of the substrate 10 over the main polishing pad 30 and a second portion of the substrate over the outer polishing pad 56. By selection of the position of the carrier head 70 (and thus substrate 10) in view of the shape and location of the outer polishing surface 54, and by control of the degree of deformation of the flange 50 by the contactless actuator 51, the polishing system 10 can establish a differential in polishing rates in different annular zones on the substrate. This effect can be used to provide polishing correction, e.g., edge-correction, of the substrate 10.

The carrier head 70 can rotate to provide angularly symmetric edge-correction (i.e., symmetric about the axis of rotation of the carrier head and thus about the center of the substrate). However, in some implementations, the carrier head 70 does not rotate during the polishing correction provided by the outer polishing pad 56. This permits the corrective polishing to be performed in an angularly asymmetric manner.

The polishing system 20 can have a second annular flange 60 that projects radially inward from the platen 24 into the aperture 26. If not deflected or deformed, a top surface of the second annular flange 60 is coplanar with the upper surface 38 of the platen 24. The second annular flange 60 has an outer edge that is secured to and rotatable with the platen 24, and the inner edge of the second annular flange 60 is fixed relative to the top surface of the platen 24. The second annular flange 60 can be vertically deflectable such that an inner edge of the annular flange 60 is vertically movable relative to the outer edge when a second contactless actuator 61 applies pressure to an underside of the annular flange 60 in an angularly limited region 44. The second contactless actuator 61 can have, for example, an air cylinder 48 mounted to a pivoting arm 49 that can swing upwardly and downwardly to adjust the distance between the second annular flange 60 and an actuator head 46. Alternatively, the second contactless actuator 61 can be static and fixed near the polishing station 20 with an actuator head 46 having preset distance between the second annular flange 60 and the actuator head 46.

The carrier head 70 can be movable to selectively position a portion of the substrate 10 over the main polishing pad 30 and the inner polishing pad 66. Where the platen 24 includes the aperture 26, the carrier head 70 can be laterally positioned such that the substrate 10 partially overhangs the hole 31 in the main polishing pad 30 during polishing.

The polishing system 20 can reduce in-plane non-uniformity without jeopardizing throughput by replacing the center region of the main polishing pad 30 by the hole 31. To see this, the polishing rate near the center of the main pad 30 can have a decreased polishing rate as compared to a more outer portion of the main pad 30, as velocity of the pad increases proportionally as a function of radial distance r from the axis of rotation 25 (see FIG. 2). Therefore, a portion of the main pad 30 with a smaller value of r will have a lower velocity and will have a slower polishing rate. Given that, replacing the less efficient central part of the main pad 30 by an inner polishing pad 66 configured for polishing edge-control can yield the optimal polishing quality while at least maintain the original throughput.

The polishing system 20 can include an inner polishing pad 66 that is supported by and secured to the second annular flange 60. The inner polishing pad 66 can be angularly segmented. The angular segmentation of the inner polishing pad 66 can be done by channels 67. Channels 67 can also be used to drain the polishing by-product, e.g., slurry or debris from polishing.

The polishing surface 64 of the inner polishing pad 66 can be annular. In some implementations, the inner polishing pad 66 includes an annular projection that extends upwardly from a lower layer. The channels 67 can divide the annular projection into a plurality of arcs. A top surface of the annular projection provides the inner polishing surface 64.

The annular projection has a width w. The width w can be uniform angularly around the platen. The annular projection can have a rectangular cross section (perpendicular to the top surface of the second annular flange 60 or to the polishing surface 36).

Since only one segmented pad may be positioned under the substrate 10 at a time, the inner and/or outer pads that are not below the carrier head 70 can be conditioned by the conditioning system 40 as they spin about the platen 24 axis of rotation 25.

The polishing surface of the inner polishing pad 66 can be annular to be supported by and secured to the top of the second annular flange 60. The carrier head 70 can hold the substrate 10 in contact with the main polishing pad 30 and is movable to selectively position a portion of the substrate 10 over the main polishing pad 30 and the inner polishing pad 66 to provide correction, e.g., edge-correction, of the substrate 10.

The polishing system 20 can have the outer polishing pad 56 be harder than the main polishing pad 30, or softer than the main polishing pad 30. The outer polishing pad 56 can be composed of the same material as the main polishing pad 30, or composed of a different material than the main polishing pad 30.

The polishing system 20 can have the inner polishing pad 66 be harder than the main polishing pad 30, or softer than the main polishing pad 30. The inner polishing pad 66 can be composed of the same material as the main polishing pad 30, or composed of a different materials than the main polishing pad 30.

The polishing system 20 can have the outer polishing pad 56 be harder than the inner polishing pad 66, or softer than the inner polishing pad 66. The outer polishing pad 56 can be composed of the same material as the inner polishing pad 66, or composed of a different material than the inner polishing pad 66.

Referring back to FIG. 3, the contactless actuator 51 can include a magnetic actuator head 46 (See FIGS. 4 and 5), a fluid jet actuator (See FIG. 6) or an air jet actuator (See FIG. 7).

Figure 4:
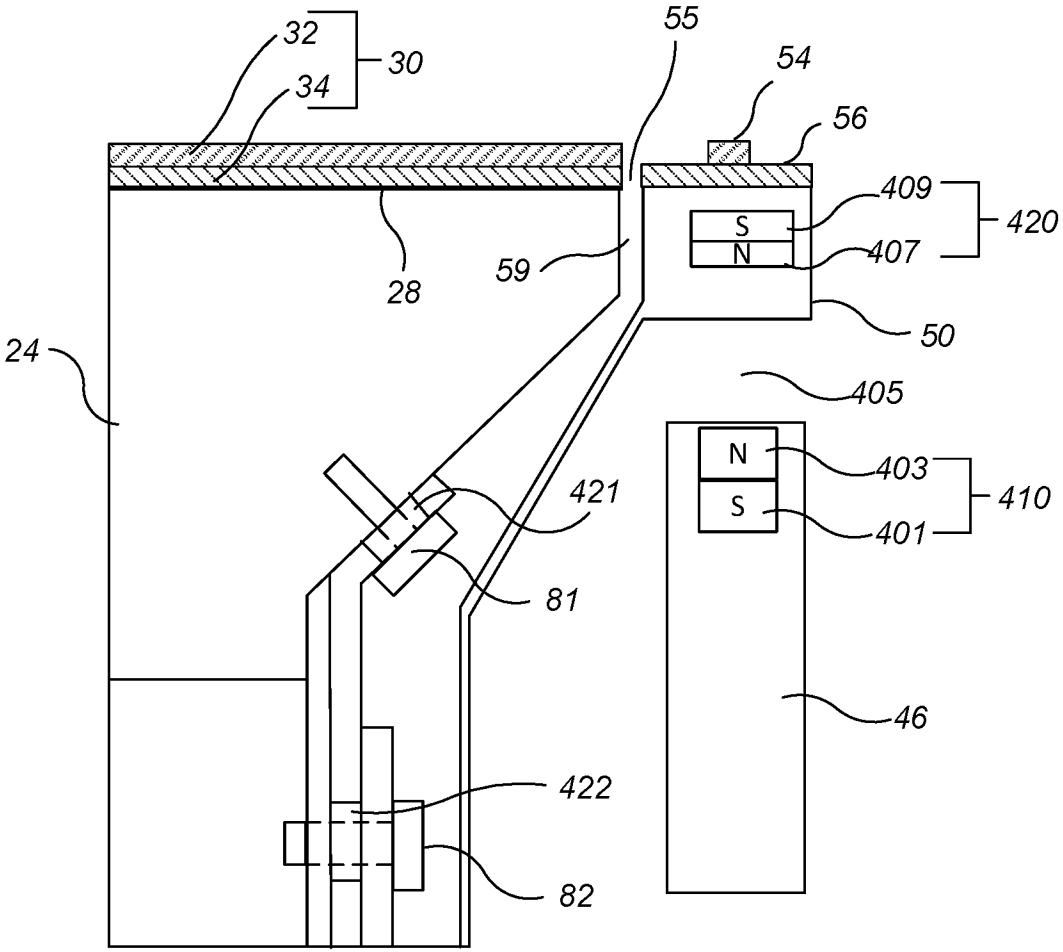
FIG. 4 shows a schematic cross-sectional view of an example chemical mechanical polishing system with a contactless actuator having a permanent magnet.
Figure 5:
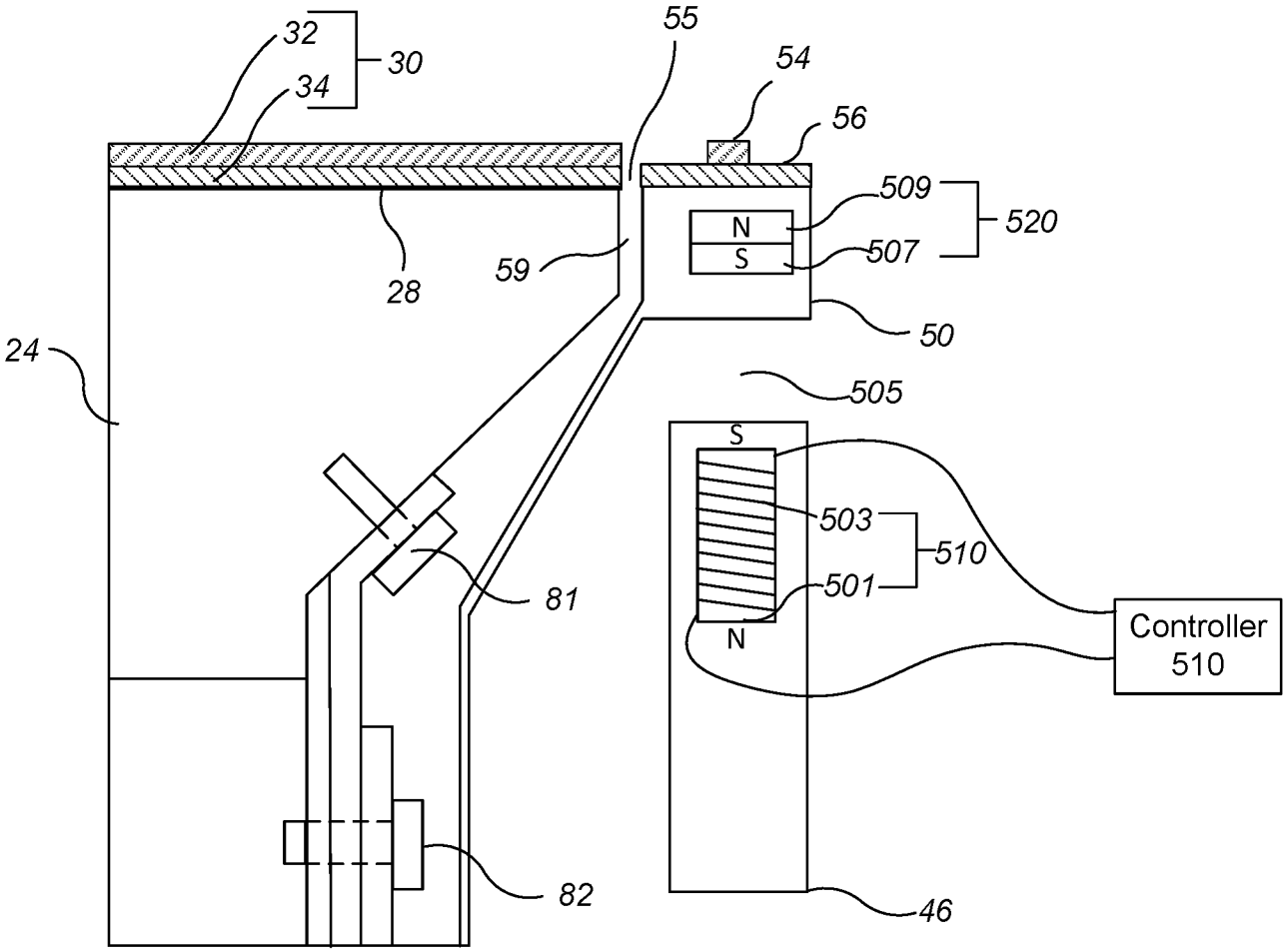
FIG. 5 shows a schematic cross-sectional view of an example chemical mechanical polishing system with a contactless actuator having an electromagnet.

Referring to FIGS. 4 and 5, for implementations involving magnetic actuation, the annular flange 50 includes a permanent magnet. The permanent magnet can be secured to an outer portion of the annular flange 50 and/or an inner portion of the annular flange 60. The magnetic actuator head can include another permanent magnet or an electromagnet. To provide an upward pressure to an annular flange 50 or 60, the permanent magnet secured to the annular flange and the permanent magnet or electromagnet secured in the actuator head should be positioned opposite to each other to generate a repulsive force between the annular flange and the actuator head. The amplitude of repulsive force, or the upward pressure to the annular flange, increases nonlinearly with the decrease of the distance between the annular flange and the actuator head.

FIG. 4 shows a schematic cross-sectional view of an example chemical mechanical polishing system with a contactless actuator having a permanent magnet. As shown in FIG. 4, a permanent magnet 420 is secured to the flange 50, e.g., embedded inside the flange 50. Alternatively, the permanent magnet 420 can be secured to the outer surface of the annular flange 50, e.g., the bottom surface of the annular flange 50. The permanent magnet 420 has two poles, a north pole 407 downward and a south pole 409.

The magnetic actuator 51 includes a magnetic actuator head 46. Another permanent magnet 410 is secured to the magnetic actuator head 46, e.g., embedded in the actuator head 46. Alternatively, the permanent magnet 410 can be secured on the outer surface of the actuator head 46, e.g., on the top surface of the actuator head 46. The permanent magnet 410 has two poles, a north pole 403 and a south pole.

The two permanent magnets 410 and 420 are positioned in a manner that the same poles of the two permanent magnets are facing each other. For example, as shown in FIG. 4, the north pole 407 of the magnet 420 faces the north pole 403 of the magnet 410.

The shape of permanent magnet 420 can be a ring as the outer polishing pad 56, or a plurality of radial arcs like the radial arcs 53. Each magnet arc can share the same width w (measured along a radius of the platen) of the radial arcs 53 or shorter. The width w can be uniform for each magnet arc. Each arc can have the same dimension, or the widths w can vary from one magnet arc to another. The total number of permanent magnets 420 secured in the annular flange can be one or more. Similarly, the total number of permanent magnets 410 secured in the magnetic actuator head can be one or more. For example, the number of permanent magnet 420 can be 8 while the number of permanent magnet 410 can be 2.

The repulsive force generated by permanent magnets 410 and 420 generally depends on the distance of the gap 405 between the annular flange 50 and the actuator head 46, or more strictly, the distance between and relative orientation of the magnets 420, 410. When there is no need of magnetic force between the actuator head 46 and the flange 50, the actuator head 46 can be positioned away from the flange 50. There is no particular maximum distance, but the head can be at least 3 mm from the flange 50. On the other hand, when the controller of the polishing apparatus determines that an increase in pressure applied on the platen edge is required, the actuator head 46 is moved closer to the flange to substantially deform the flange by the upward magnetic force. In this case the gap 405 is narrower, but can be at least 1 mm across. The amplitude of the repulsive force, or equivalently the upward pressure applied on the annular flange 50, can change nonlinearly as the distance of the gap 405 changes.

To adjust the force on the flange, the actuator 51 can have an arm 49 attached to an air cylinder 48. The arm 49 can move the actuator 46 upwardly and downwardly based on the motion of air cylinder. The distance of the gap 405 can be determined and adjusted by a controller in order to apply a proper upward pressure onto the annular flange. The annular flange 50 can be deflected upwardly to press the polishing pad 56 onto a substrate 10 to control the polishing rate on the edge of the substrate. The deflection of the annular flange can be 1 mm to 3 mm, in order to ensure contact between the polishing pad 56 and the substrate 10 with extra external pressure.

A plurality of bolts 81 and 82 can be used to secure the flange 50 to the platen 24, as shown in FIG. 4. Moreover, the first plurality of bolts 81 are screwed into the base of the platen vertically or diagonally while the second plurality of bolts 82 are screwed into the base of the platen horizontally. The bolts 81, 82 can be used to adjust the surface height of the main polishing pad 30 and also adjust the size of the gap 55 at the same time. For example, slots 421, 422 can be formed in a base of the flange 50, and bolts 81, 82 can be inserted through the slot. By sliding the base of the flange 50 along the bottom of the platen 24 before tightening the bolts 81, 82, the vertical and horizontal position of the flange 50 can be set. The combination of the bolts 81 and 82 can be used to adjust the surface height of the main polishing pad 30 to be substantially co-plane with the surface of the outer polishing pad 56, and can adjust the size of the gap 55 accordingly.

Similarly to FIG. 4, FIG. 5 shows a schematic cross-sectional view of an example chemical mechanical polishing system with a contactless actuator having an electromagnet. The annular flange 50 has a permanent magnet 520. An electromagnet 510 is secured to the magnetic actuator head, e.g., embedded inside the magnetic actuator head 46. Alternatively, the electromagnet 510 can be located on an outer surface, e.g., the top surface, of the magnetic actuator head 46. The electromagnet 510 includes a coil 503 which can optionally surround a low magnetic permeability core 501. The coil 503 is connected to a controller 510. The controller 510 can determine the current change flowing in the coil 503 in order to control the field strength and the polarity of the electromagnet 510. As shown in FIG. 5, the controller 510 can determine and cause a voltage source to apply a current to the electromagnet 510 such that the electromagnet generates a non-zero magnetic field with the same poles of the permanent magnet 520 and electromagnet 510 facing each other. For example, as shown in FIG. 5, the south pole 507 of the permanent magnet 520 faces the south pole of the electromagnet 510.

Similarly to FIG. 4, the shape of permanent magnet 420 can be a ring like the outer polishing pad 56, or a plurality of radial arcs like the radial arcs 53. The total number of permanent magnets 520 secured in the annular flange can be one or more. Similarly, the total number of electromagnets 510 secured in the magnetic actuator head 46 can be one or more. For examples. The number of permanent magnet 520 can be 12 while the number of electromagnet 510 can be 3.

Similarly, the repulsive force generated between the permanent magnet 520 and the electromagnet 510 generally depends on the size of the gap 505 between the annular flange 50 and the actuator head 46, or more strictly, the distance and relative orientation between the permanent magnet 520 and the electromagnet 510. The amplitude of the repulsive force, or equivalently the upward pressure applied on the annular flange 50, can be changed linearly as the field strength of the electromagnet 510 controlled by the controller 510 changes. In some implementations, the actuator 51 can be fixed in a position with a preset initial size of the gap 505. The annular flange 50 can be deflected upwardly to press the polishing pad 56 onto a substrate 10. The total amount of deflection of the annular flange dependents on the field strength of the electromagnet 510 when the actuator is fixed at the position. The field strength can be controlled according to an in-situ polishing control system that measures the real time polishing process of a substrate. The controller 510 can take as input the polishing process and adjust current changing rate and amplitude to increase or decrease the field strength of the electromagnet 510 accordingly. The deflection of the annular flange can be 1 mm to 3 mm, in order to ensure a positive contact pressure between the polishing pad 56 and the substrate 10.

Alternatively, the contactless actuator 51 can include a fluid jet actuator head. The fluid jet actuator head includes a fluid nozzle connected to a fluid resource through a pipe. The fluid resource can have fluid such as water. Between the fluid resource and the fluid nozzle, a valve can be incorporated to turn on and off the fluid from the fluid resource to the fluid nozzle. The fluid jet actuator head is configured to jet fluid from the nozzle to the annular flange when the valve is turned on.

Figure 6:
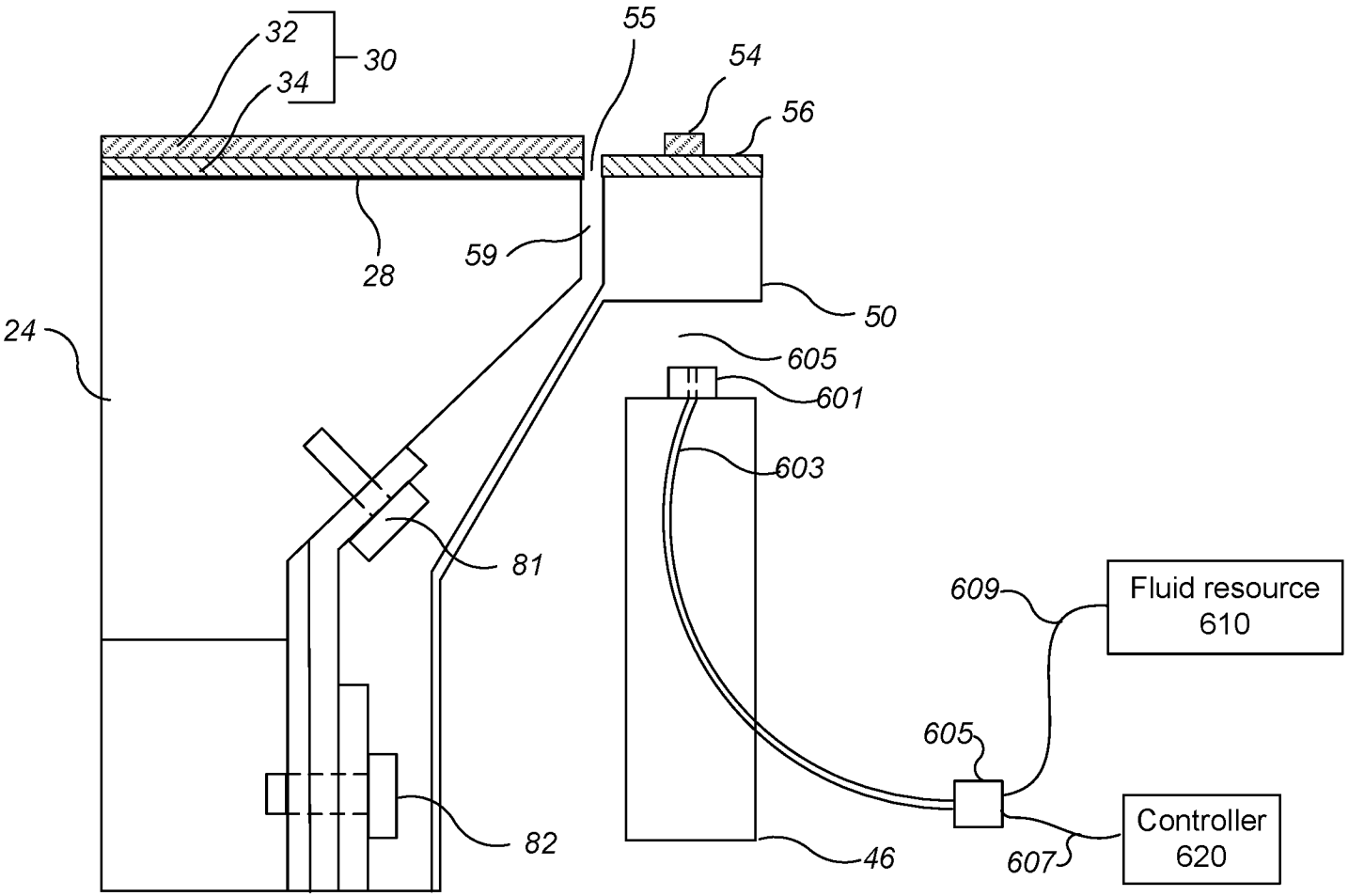
FIG. 6 shows a schematic cross-sectional view of an example chemical mechanical polishing system with a contactless actuator having a fluid jet nozzle.

FIG. 6 shows a schematic cross-sectional view of an example chemical mechanical polishing system with a contactless actuator having a fluid jet nozzle. The contactless actuator 51 includes a fluid jet actuator head 46. The fluid jet actuator head 46 includes a fluid nozzle 601 positioned on an outer surface, e.g., the top surface, of the actuator head 46. The fluid nozzle 601 is connected to one end of a fluid valve 605 through a conduit 603, e.g., piping or flexible tubing. The other end of the fluid valve 605 is connected to a fluid source 610. The fluid valve 605 also connects to a controller 620 by a signal line 607 such that the controller 620 can send signals through the signal line 607 to turn on or off the valve 605. When the valve 605 is turned off, the fluid pressure from the fluid resource 610 cannot reach to the fluid in the pipe 603 thus there is no fluid jetting out from the nozzle 601. However, once the valve 605 is turned on, the fluid from the fluid source 610 flows, e.g., due to a pump or back pressure, through the nozzle 601 and sprays onto the bottom surface of the annular flange 50. The valve 605 can be turned on partially by the controller 620 in order to control the flow rate of the fluid. The fluid can be a gas, e.g., air or nitrogen, or a liquid, e.g., water. In either case the fluid can be filtered before flowing through the nozzle.

The upward pressure applied on the annular flange is determined by the linear momentum carried by the fluid jetting through the fluid nozzle 601. The higher the flow rate, the stronger the upward pressure onto the annular flange 50. In some implementations, the nozzle 610 can also control the flow rate to increase or decrease the pressure applied on the annular flange. The upward pressure can deflect the annular flange upwardly and contacts with a substrate 10 and eventually apply more pressure on the substrate during polishing edge-control.

The controller 620 can connect to an in-situ monitoring system that can measure real time polishing progress over a substrate under polishing and determine a signal to be sent to the valve through the signal line 607 to adjust how much the valve 605 is turned on. In some implementations, the valve 605 has no intermediate states between switched on and off states. However the fluid resource can connect to a fluid pump that can change hydraulic pressure of the fluid resource controlled by a controller through a pressure line.

In some implementations, the size of gap 605 can affect the upward pressure applied on the annular flange 50, as the larger the gap is, the less focus the fluid is jet onto the bottom surface of the annular flange 50, which can reduce the upward pressure. In general, the gap 605 is preset to be small, for example 1-3 mm, thus the effect of size of gap 605 can be substantially ignored, especially when the hydraulic pressure of the fluid resource 610 is much higher than the normal atmospheric pressure.

Alternatively, the contactless actuator 51 can include an air jet actuator head. The air jet actuator head includes an air nozzle connected to a compressed air resource through a pipe. The compressed air resource can include inert gas, such as nitrogen. Between the compressed air resource and the air nozzle, a valve can be incorporated to turn on and off the connection between the compressed air resource and the air nozzle. The air jet actuator head is configured to jet air from the nozzle to the annular flange when the valve is turned on.

The total number of fluid resource 610 can be one or more. For example, the total number of fluid resources 610 can be 5. Each of the fluid resources 610 can have a respective pressure, or a pressure controlled by a respective controller independently. The valve 605 can be a multi-thread valve that the other end of the valve connects to a plurality of fluid resources. Alternatively, the contactless actuator 51 can have a plurality of valves each connecting to a respective fluid resource 610 and controlled by the controller 190 independently.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A polishing system, comprising:

a platen having a top surface to support a main polishing pad, the platen rotatable about an axis of rotation that passes through approximately the center of the platen;

an annular flange projecting radially outward from the platen to support an outer polishing pad, the annular flange being a unitary body having an inner edge secured to and rotatable with the platen and vertically fixed relative to the top surface of the platen, the annular flange being deformable and vertically deflectable such that an outer edge of the annular flange is vertically movable relative to the inner edge;

a contactless actuator configured to apply pressure to an underside of the annular flange in an angularly limited region such that the angularly limited region of the annular flange and an angularly limited portion of the outer polishing pad are lifted relative to an undeformed portion of the annular flange without contacting the annular flange; and a carrier head to hold a substrate in contact with the main polishing pad and movable to selectively position a portion of the substrate over the outer polishing pad.

2. The polishing system of claim 1, wherein the contactless actuator comprises a magnetic actuator head.

3. The polishing system of claim 2, wherein the annular flange comprises a first permanent magnet secured to an outer portion of the annular flange, wherein the magnetic actuator head comprises a second permanent magnet positioned opposite to the first permanent magnet with no contact in a manner that one pole of the first permanent magnet faces the same pole of the second permanent magnet.

4. The polishing system of claim 2, wherein the annular flange comprises a first permanent magnet secured to an outer portion of the annular flange, wherein the magnetic actuator head comprises a electromagnet positioned opposite to the first permanent magnet with no contact in a manner that one pole produced by the electromagnet faces the same pole of the first permanent magnet.

5. The polishing system of claim 1, wherein the contactless actuator comprises a fluid jet actuator head.

6. The polishing system of claim 5, wherein the fluid jet actuator head comprises a nozzle connected to a fluid resource, the fluid jet actuator head configured to jet fluids to apply pressure onto the annular flange.

7. The polishing system of claim 1, wherein the contactless actuator comprises an air jet actuator head.

8. The polishing system of claim 7, wherein the air jet actuator head comprises a nozzle connected to a compressed air resource, the air jet actuator head configured to jet air to apply pressure onto the annular flange.

9. The polishing system of claim 1, further comprising:

an aperture in the top surface of the platen in approximately the center of the platen;

a second annular flange projecting radially inward from the platen into the aperture to support an inner polishing pad, the second annular flange being a unitary body having an outer edge secured to and rotatable with the platen and vertically fixed relative to the top surface of the platen, the second annular flange being deformable and vertically deflectable such that an inner edge of the second annular flange is vertically movable relative to the outer edge; and a second contactless actuator configured to apply pressure to an underside of the second annular flange in an angularly limited region without contacting the annular flange such that the angularly limited region of the second annular flange and an angularly limited portion of the inner polishing pad are lifted relative to an undeformed portion of the second annular flange.

10. The polishing system of claim 9, wherein the second contactless actuator comprises a magnetic actuator head.

11. The polishing system of claim 10, wherein the annular flange comprises a first permanent magnet secured to an inner portion of the annular flange, wherein the magnetic actuator head comprises a second permanent magnet positioned opposite to the first permanent magnet with no contact in a manner that one pole of the first permanent magnet faces the same pole of the second permanent magnet.

12. The polishing system of claim 10, wherein the annular flange comprises a first permanent magnet secured to an inner portion of the annular flange, wherein the magnetic actuator head comprises a electromagnet positioned opposite to the first permanent magnet with no contact in a manner that one pole produced by the electromagnet faces the same pole of the first permanent magnet.

13. The polishing system of claim 9, wherein the contactless actuator comprises a fluid jet actuator head.

14. The polishing system of claim 13, wherein the fluid jet actuator head comprises a nozzle connected to a fluid resource, the fluid jet actuator head configured to jet fluids to apply pressure onto the annular flange.

15. The polishing system of claim 9, wherein the contactless actuator comprises an air jet actuator head.

16. The polishing system of claim 15, wherein the air jet actuator head comprises a nozzle connected to a compressed air resource, the air jet actuator head configured to jet air to apply pressure onto the annular flange.

17. The polishing system of claim 1, wherein an upper surface of the annular flange is coplanar to a top surface of the platen.

18. A polishing system, comprising:

an annular platen having a top surface to support a main polishing pad, the annular platen having an aperture in the top surface of the platen in approximately the center of the platen, the platen rotatable about an axis of rotation that passes through approximately the center of the platen;

an annular flange projecting radially inward from the platen into the aperture to support an inner polishing pad, the annular flange being a unitary body having an outer edge secured to and rotatable with the platen and vertically fixed relative to the top surface of the platen, the annular flange being deformable and vertically deflectable such that an inner edge of the annular flange is vertically movable relative to the outer edge;

a contactless actuator configured to apply pressure to an underside of the annular flange in an angularly limited region such that the angularly limited region of the annular flange and an angularly limited portion of the inner polishing pad are lifted relative to an undeformed portion of the annular flange without contacting the annular flange; and a carrier head to hold a substrate in contact with the main polishing pad and movable to selectively position a portion of the substrate over the inner polishing pad.

19. The polishing system of claim 18, wherein the contactless actuator comprises a magnetic actuator head, wherein a first permanent magnet is secured to an inner portion of the annular flange, wherein the magnetic actuator head comprises a second permanent magnet positioned opposite to the first permanent magnet with no contact in a manner that one pole of the first permanent magnet faces the same pole of the second permanent magnet.

20. The polishing system of claim 18, wherein the contactless actuator comprises a magnetic actuator head, wherein a first permanent magnet secured to an inner portion of the annular flange, wherein the magnetic actuator head comprises an electromagnet positioned opposite to the first permanent magnet with no contact in a manner that one pole produced by the electromagnet faces the same pole of the first permanent magnet.

* * * * *